US009867470B2

(12) United States Patent
Koch et al.

(10) Patent No.: US 9,867,470 B2
(45) Date of Patent: Jan. 16, 2018

(54) ACTUATOR ASSEMBLY FOR AN ADJUSTABLE SEATING OR LYING FURNITURE ITEM AS WELL AS AN ADJUSTABLE SEATING OR LYING FURNITURE ITEM

(71) Applicant: LOGICDATA Electronic & Software Entwicklungs GmbH, Deutschlandsberg (AT)

(72) Inventors: Walter Koch, Schwanberg (AT); Daniel Kollreider, Graz (AT); Haymo Niederkofler, Graz (AT)

(73) Assignee: LOGICDATA Electronic & Software Entwicklungs GmbH, Deutschlandsberg (AT)

( * ) Notice: Subject to any disclaimer, the term of this patent is extended or adjusted under 35 U.S.C. 154(b) by 0 days.

(21) Appl. No.: 15/026,245

(22) PCT Filed: Aug. 19, 2014

(86) PCT No.: PCT/EP2014/067684
§ 371 (c)(1),
(2) Date: Mar. 30, 2016

(87) PCT Pub. No.: WO2012/049078
PCT Pub. Date: Apr. 9, 2015

(65) Prior Publication Data

US 2016/0235207 A1 Aug. 18, 2016

(30) Foreign Application Priority Data

Oct. 1, 2013 (EP) ..... 13186880

(51) Int. Cl.
*A47C 7/58* (2006.01)
*A47C 20/04* (2006.01)
(Continued)

(52) U.S. Cl.
CPC ..... *A47C 7/58* (2013.01); *A47C 1/02* (2013.01); *A47C 17/04* (2013.01); *A47C 17/86* (2013.01); *A47C 20/041* (2013.01); *A47C 20/042* (2013.01)

(58) Field of Classification Search
CPC ..... A47C 7/00
(Continued)

(56) References Cited

U.S. PATENT DOCUMENTS 4,853,990 A 8/1989 Elder et al.
2008/0012414 A1* 1/2008 Dewert ..... A47C 1/0342 297/354.11

FOREIGN PATENT DOCUMENTS

DE 156254 C 11/1904
DE 156254 C 11/1904
(Continued)

*Primary Examiner* — Fredrick Conley
(74) *Attorney, Agent, or Firm* — McDermott Will & Emery LLP

(57) ABSTRACT

The invention relates to an actuator assembly for an adjustable seating or lying furniture item, in particular for an adjustable bed or an adjustable comfortable armchair, comprising a spindle that can be activated by means of a drive for causing axial rotation, which is mounted in a stationary manner. The actuator assembly also comprises a sliding block mechanically coupled with the spindle, the sliding block can be moved parallel in relation to a longitudinal axis of the spindle when said spindle is activated. The actuator assembly also comprises a coupling element mounted in a manner allowing it to be moved in relation to the spindle with a first slotted guide, in which the sliding block is at least partially guided in such a way that the coupling element is shifted when the spindle is activated, in order to move a segment of the adjustable seating or lying furniture item that can be mechanically coupled with the coupling element. The
(Continued)

Figure 1:
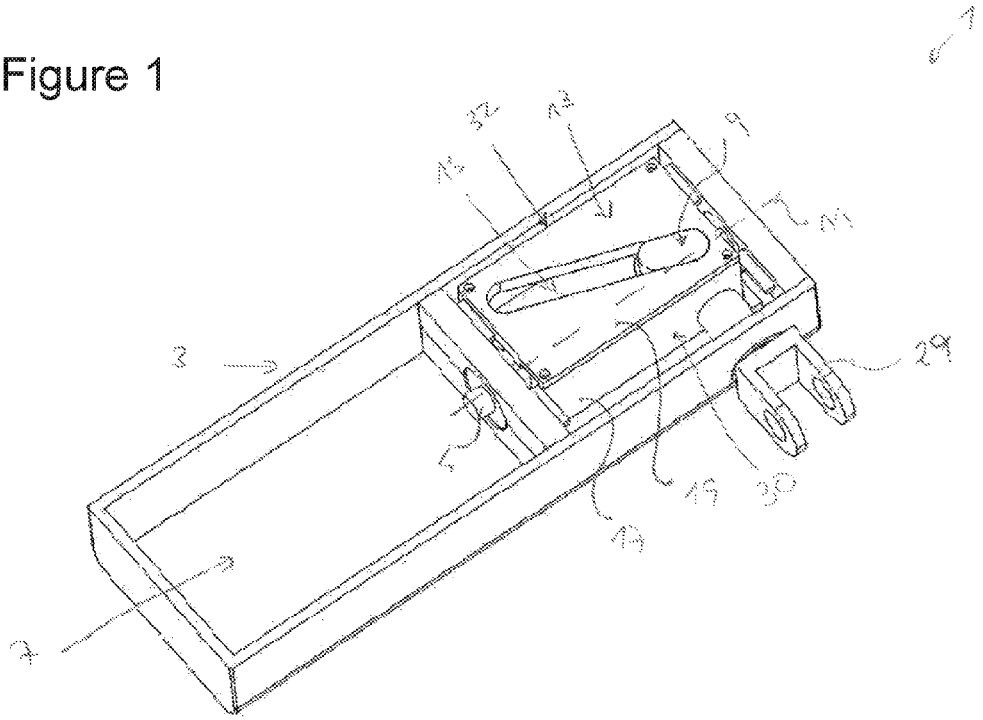

invention further relates to an adjustable seating or lying furniture item.

13 Claims, 6 Drawing Sheets

(51) Int. Cl.
*A47C 1/02* (2006.01)
*A47C 17/04* (2006.01)
*A47C 17/86* (2006.01)

(58) Field of Classification Search
USPC ..... 297/361.1, 362.11, 362.14, 363
See application file for complete search history.

(56) References Cited

FOREIGN PATENT DOCUMENTS

| | | | |
|---|---|---|---|
| DE | 102006033982 | A1 | 1/2008 |
| DE | 202008016053 | U1 | 4/2010 |
| DE | 202008016053 | U1 | 4/2010 |
| JP | 2009056268 | A | 3/2009 |
| WO | 96/12427 | A1 | 5/1996 |

* cited by examiner

ACTUATOR ASSEMBLY FOR AN ADJUSTABLE SEATING OR LYING FURNITURE ITEM AS WELL AS AN ADJUSTABLE SEATING OR LYING FURNITURE ITEM

The invention relates to an actuator assembly for an adjustable seating or lying furniture item, in particular for an adjustable bed or an adjustable comfortable armchair. The invention further relates to an adjustable seating or lying furniture item with such an actuator assembly.

Different actuator systems are used for electrically adjustable furniture items, primarily for beds and comfortable armchairs. Such systems are combined with frames, in order to provide suitable kinematics, which can exert the necessary forces to actuate the kinematics. In bed systems mostly a plurality of bed segments are adjusted independently of each other. More or fewer segments are configured to be adjustable, depending on the individual price class. Comfortable armchairs are often moved from an upright position into a reclining position. The foot section and/or head section can thereby be moved either independently or dependently of each other.

It is the object of the present invention to describe an improved actuator assembly for an adjustable seating or lying furniture item as well as an adjustable seating or lying furniture item, which is distinguished by a simple and particularly space-saving constructional design.

According to a first aspect of the invention, an actuator assembly for an adjustable seating or lying furniture item, in particular for an adjustable bed or an adjustable comfortable armchair, is disclosed. The actuator assembly comprises a spindle that can be actuated by a drive to axially rotate, which is mounted in a stationary manner. Furthermore, the actuator assembly comprises a sliding block mechanically coupled with the spindle, which can be moved parallel in relation to a longitudinal axis of the spindle when said spindle is actuated. The actuator assembly also comprises a coupling element mounted in a manner allowing it to be moved in relation to the spindle with a first slotted guide, into which the sliding block is at least partially guided in such a way that the coupling element is shifted if the spindle is actuated, in order to move a segment of the adjustable seating or lying furniture item mechanically coupled with the coupling element.

The actuator assembly according to the first aspect provides that the only things required for moving a segment of the adjustable seating or lying furniture item are a spindle that can be actuated by a drive, a sliding block coupled with the spindle, as well as a coupling element with a first slotted guide.

A rotational movement of the spindle causes the sliding block coupled with the spindle to move parallel or axially in relation to the longitudinal axis of the spindle. The fact that the sliding block is additionally guided into the first slotted guide of the coupling element results in the position of the coupling element, which is mounted in a movable manner, being changed and shifted in one direction. The direction of the coupling element is, for example, rotated by 90° relative to a direction of motion of the sliding block. Other directions, for example at a specific angle in relation to the direction of motion of the sliding block, are also a conceivable alternative.

It is thus possible, by means of few components, to provide an actuator assembly for moving a segment of an adjustable seating or lying furniture item, with said actuator assembly primarily being distinguished by its compactness.

The actuator assembly can be configured in a very space-saving manner to take up very little room. This, for example, allows particularly slim frames to be achieved for a seating or lying furniture item. The actuator assembly can be mounted in any position on the frame, on one or two sides of the frame as well, for example, thus allowing maximum flexibility in a frame construction. The optional modularization allows a great variety of frame concepts to be designed with a single actuator assembly. Furthermore, only short levers or joint connections are needed to adjust a segment of the adjustable seating or lying furniture item. Furthermore, high transmission ratios can be achieved by the actuator assembly. In addition, high forces can be achieved for adjusting a segment of the seating or lying furniture item. In contrast to the actuator assembly, for example, linear actuators would need much more space or installation room. For instance, such linear actuators would be mounted in such a way under a bed frame that said bed frame would have a larger overall construction height and would take up a great deal of room compared with the described actuator assembly.

According to one embodiment, the actuator assembly comprises the drive, which includes a motor, in particular an electric motor, and a gear coupled with the motor, wherein the gear transmits a rotational movement to the spindle. The motor or the electric motor can, for example, be a direct current motor. The motor drives a gear, which transmits a rotational movement to the spindle according to a transmission ratio of the gear and thus allows a rotary or rotational movement of the spindle to be simply achieved, wherein the rotational speed of the spindle depends on the transmission ratio of the gear or a speed of the motor.

According to a further embodiment, the spindle comprises an external thread and the sliding block an internal thread, via which the sliding block is coupled with the external thread of the spindle. High forces can thus be transmitted to the sliding block and thus to the coupling element by a rotational movement of the spindle.

According to a further embodiment, the coupling element can be mechanically coupled with a further segment of the adjustable seating or lying furniture item in such a way that the further segment is also moved when the coupling element is shifted, thus allowing two segments of an adjustable seating or lying furniture item to be moved simultaneously. For example, a head section and a foot section of a bed can be moved in this way. The coupling element moves in one direction, wherein a shearing force is transmitted to one segment and a tensile force acts via the coupling element on the other segment.

According to a further embodiment, the first slotted guide has a course, which runs at least partially in a linear and/or curved manner. The first slotted guide can generate different motion characteristics with regard to its course. This depends on the course of the first slotted guide, which can run in a curved and/or linear manner, for example. The course can, for example, run exponentially or logarithmically and/or have a plurality of different section with various curve functions. For example, the course may have differing slopes. Consequently, the transmission ratio of the drive can be adjusted from theoretically no transmission ratio, i.e. with a groove running parallel to the longitudinal axis of the spindle, to theoretically infinite, i.e. with a first slotted guide running orthogonally to the spindle, which in turn allows high speeds or high forces to be generated. It is also possible to reverse a direction of motion of the coupling element during the course of the first slotted guide if, for example, a slope of the course of the first slotted guide has been inverted.

According to a further embodiment, the coupling element can be coupled via at least one lever with the segment and/or with the further segment of the seating or lying furniture item in an articulated manner. This allows a rotational movement to be transmitted to a segment of the seating or lying furniture item by a lever. Such a lever can be very compact and/or short, thus enabling high forces to be transmitted.

According to a further embodiment, the coupling element has a coupling housing with a cover that can be secured on the coupling housing, which at least partially surround the sliding block and the spindle. The spindle and the sliding block can thus be protected against outside influences, such as, for example, dust or access by unauthorised persons.

According to a further embodiment, the cover or the coupling housing comprises the first slotted guide. The design of the coupling element as coupling housing and cover ensures a simple and manageable assembly. In particular, the sliding block and/or the spindle can be easily dismantled and, for example, replaced.

According to a further embodiment, the cover comprises the first slotted guide and the coupling housing a second slotted guide, wherein the second slotted guide has an identical course to the first course and faces the first slotted guide, wherein the sliding block is simultaneously guided at least partially into both the first slotted guide and the second slotted guide. As a result, the sliding block is mechanically guided in a particularly secure and stable manner to the coupling element. In particular, any forces occurring due to the rotational movement of the spindle are favourably transmitted to the coupling element as a result. The wear of the coupling element and/or of the sliding block can also be reduced as a result.

According to a further embodiment, the actuator assembly is arranged in an actuator casing, wherein said actuator casing can be secured in a stationary manner on the adjustable seating or lying furniture item, in particular on a frame, thus allowing the actuator assembly to be modularly designed and secured on an adjustable seating or lying furniture item, depending on each individual case of use. This allows great flexibility during the constructional design of a seating or lying furniture item.

According to a further embodiment, the spindle is mounted in a stationary manner on the actuator casing.

According to a further embodiment, the coupling element is mounted in manner allowing it to be moved in the actuator casing.

According to a second aspect of the invention, an adjustable seating or lying furniture item is disclosed, comprising at least two segments connected in an articulated manner and an actuator assembly according to the first aspect of the invention. The coupling element of the actuator assembly is thereby mechanically coupled with at least one segment in such a way that, when the spindle is actuated, a movement of the coupling element is transmitted to the at least one segment for adjusting the at least one segment.

The adjustable seating or lying furniture item according to the second aspect essentially allows the aforementioned advantages. Further advantageous embodiments are described in the following, detailed description of exemplary embodiments with the aid of the enclosed illustrations.

Elements having the same function or construction are provided with the same reference numerals throughout the figures.

Figure 2:
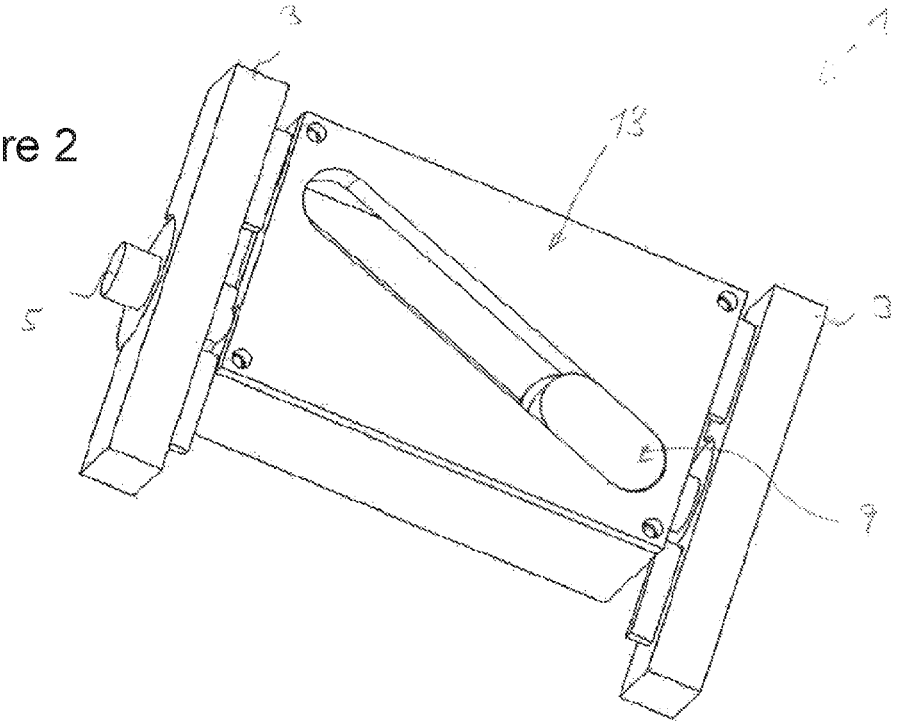
Figure 3:
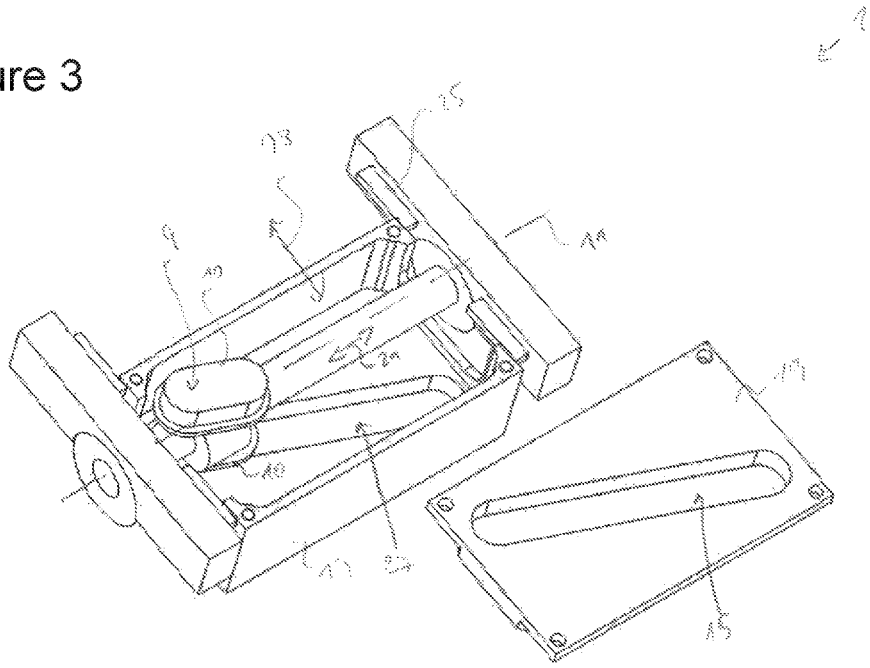
Figure 4:
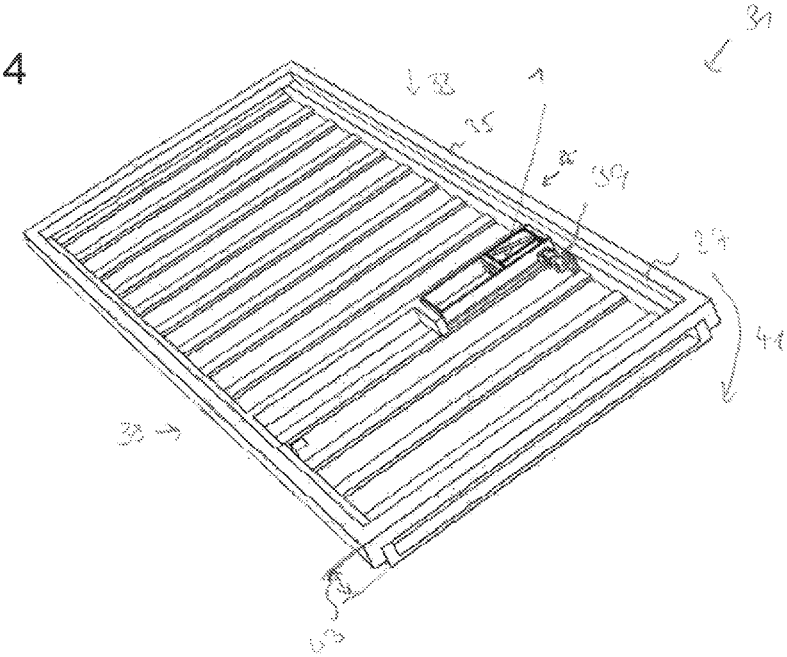
Figure 5:
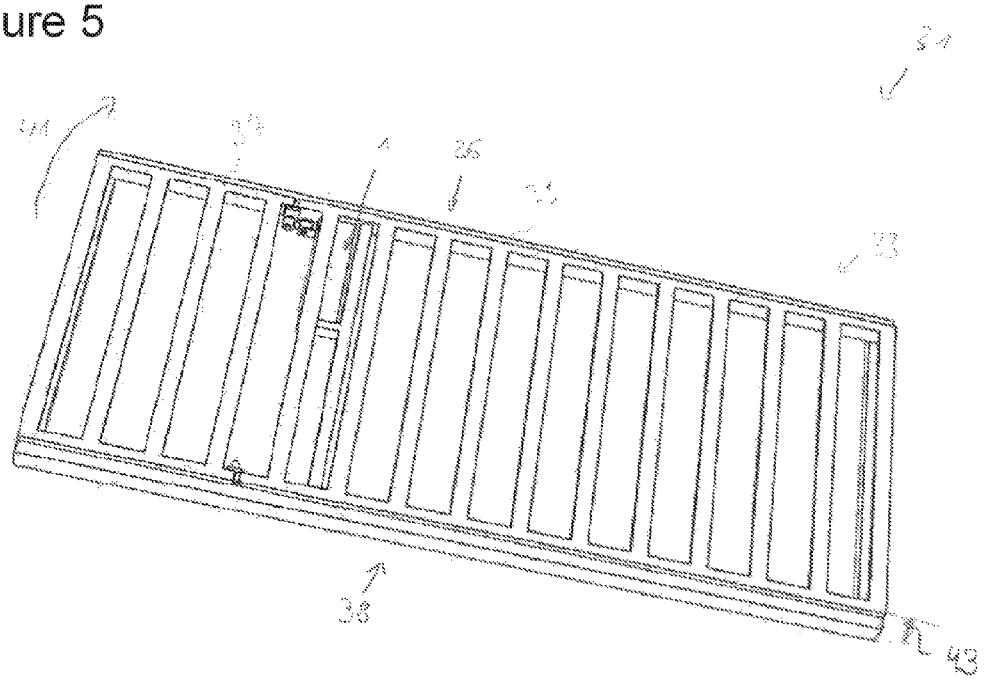
Figure 6:
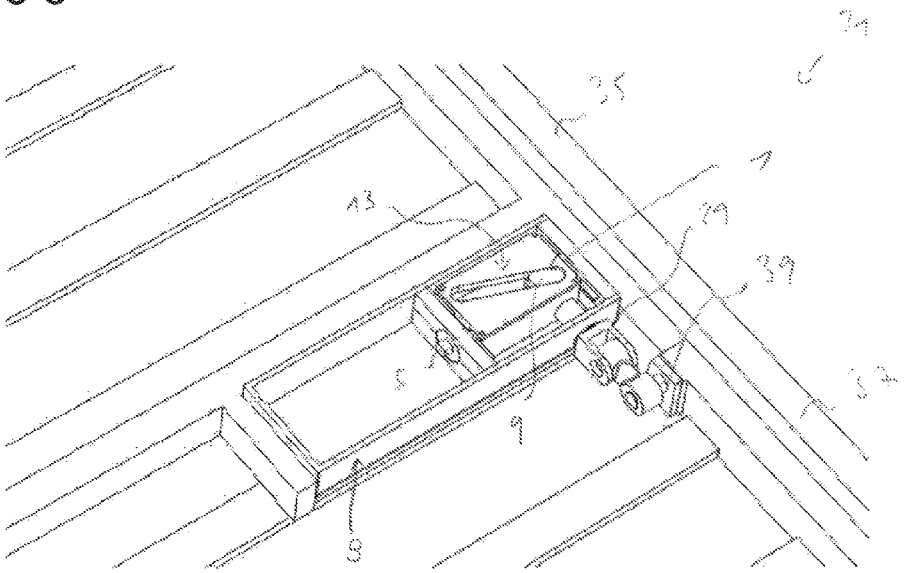
Figure 7:
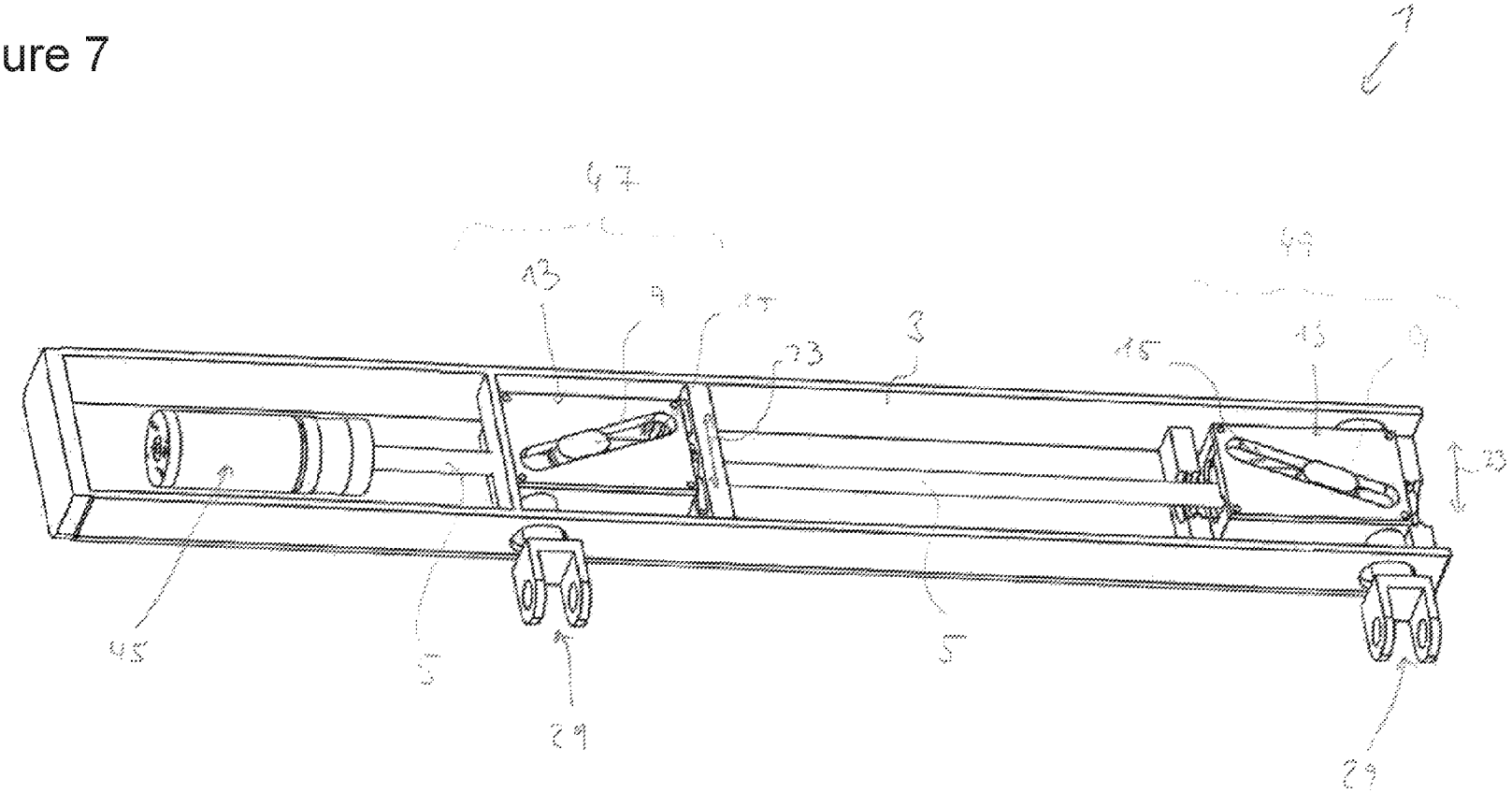
Figure 8:
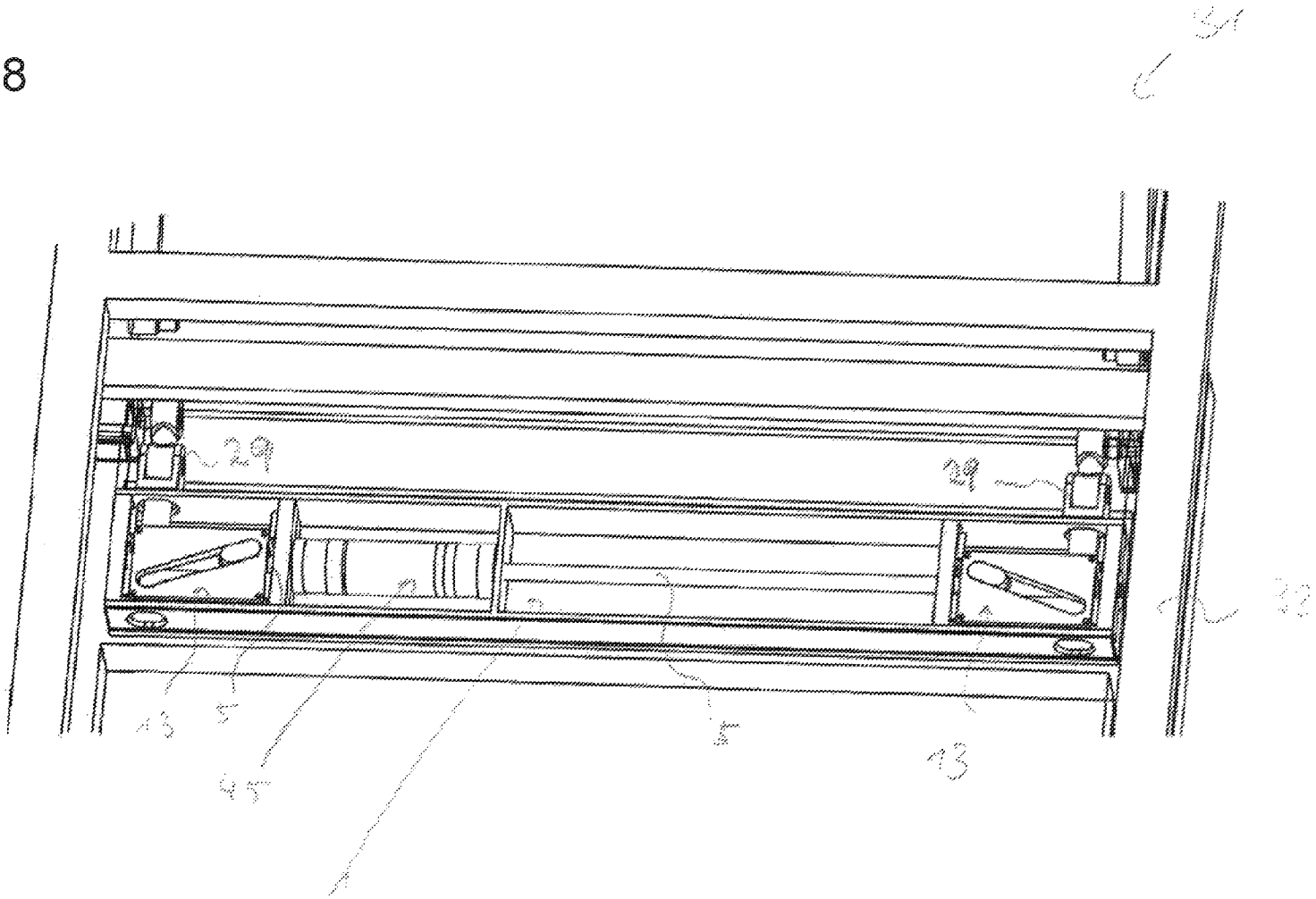
Figure 9:
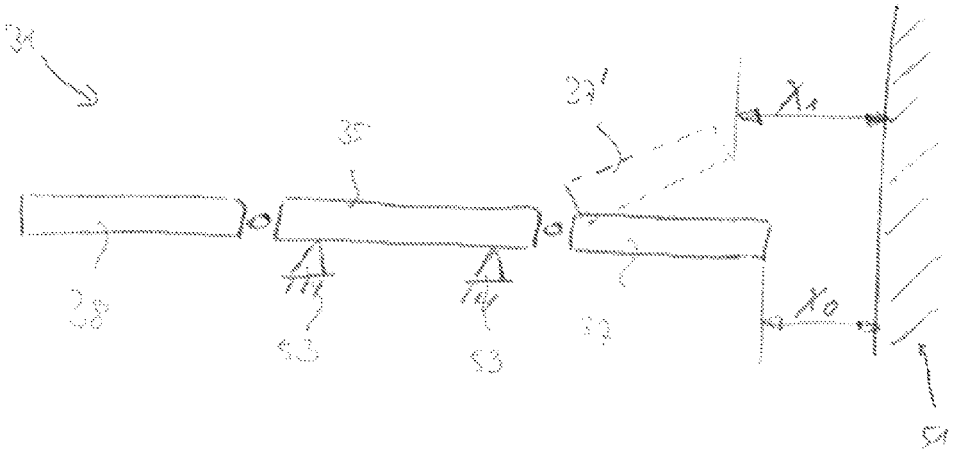
Figure 10:
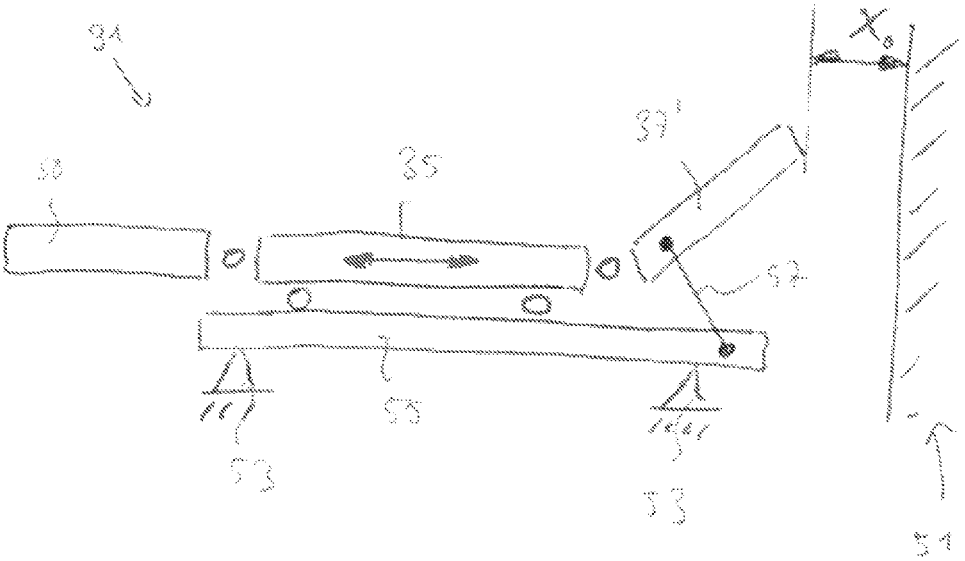

The figures show in:

FIG. 1 a perspective, schematic view of an actuator assembly with an actuator casing, FIG. 2 a perspective, schematic partial view of the actuator assembly with the coupling element, FIG. 3 a second perspective, schematic partial view of the actuator assembly with the coupling element, FIG. 4 a perspective, schematic view of an adjustable lying furniture item with the actuator assembly, FIG. 5 a second perspective, schematic view of the adjustable lying furniture item with the actuator assembly, FIG. 6 a perspective, schematic partial view of the adjustable lying furniture item with the actuator assembly, FIG. 7 a perspective, schematic view of a further actuator assembly with an actuator casing, FIG. 8 a perspective, schematic partial view of an adjustable lying furniture item with a further actuator assembly, FIG. 9 a schematic side view of an adjustable lying furniture item near a wall and FIG. 10 a second schematic side view of an adjustable lying furniture item near a wall.

FIG. 1 shows a perspective, schematic view of an actuator assembly 1 for an adjustable seating or lying furniture item. The actuating assembly has an actuator casing 3. In this case, no cover of the actuator casing 3 is illustrated in FIG. 1. The spindle 5 is mounted in a stationary manner in the interior of the actuator casing 3. The spindle 5 is configured as a shaft and can be actuated via a drive in such a way that the spindle 5 can be axially rotated by the drive. Said drive is not illustrated in FIG. 1. The drive can, for example, comprise a motor, or respectively an electric motor or direct current motor, and include a gear coupled with the motor. The drive can be arranged in the left-hand area 7 of the actuator casing 3 in FIG. 1.

The spindle 5 is mechanically coupled with a sliding block 9. Said sliding block 9 can be moved parallel in relation to a longitudinal axis 11 of the spindle 5 when said spindle 5 is actuated. The sliding block 9 has an internal thread for this purpose, via which the sliding block 9 is mechanically engaged or coupled with an external thread of the spindle 5. The sliding block 9 is thus screwed onto the spindle 5.

Furthermore, the actuator assembly 1 also comprises a coupling element 13 which has a first slotted guide 15 and is mounted in a manner allowing it to be moved in relation to the spindle 5. The sliding block 9 is guided in first slotted guide 15 of the coupling element 13. Said coupling element 13 is guided in a movable manner to the actuator casing 3. The coupling element 13 has a coupling housing 17 as well as a cover 19 and can also be designated as coupling box.

Further details on the actuator assembly 1 are described based on FIG. 2 and FIG. 3, with each of the latter illustrating a perspective, schematic partial section of the actuator assembly 1, which in particular shows the coupling element 13 in an enlarged view.

FIG. 2 shows an enlarged illustration of the coupling element 13 and FIG. 3 shows the actuator assembly 1 with an opened coupling element 13, wherein the cover 19 of the coupling element 13 has been removed from the coupling housing 17. The cover 19 can, for example, be secured to the coupling housing 17 by screw connections. Alternative connecting techniques for securing the cover 19, such as bonding or riveting, for example, are conceivable.

When the spindle 5 is actuated, the sliding block 9 axially shifts in relation to the longitudinal axis 11 of the spindle 5 according to the double arrow direction 21, as shown in FIG. 3. The coupling element 13, which is mounted in a movable manner on the actuator casing 3, shifts as a result of the sliding block 9 being guided via the first slotted guide 15 of the coupling element 13 or of the cover 19. A direction of motion of the coupling element 13 is thereby perpendicular to the longitudinal axis 11, according to the double arrow 23. The coupling element 13 is thereby guided to the actuator casing via ribs 25, which are engaged in a groove of the coupling housing 17 (not illustrated).

It is conceivable in other constructive embodiments that the coupling element 13 performs a movement when the spindle 5 is actuated, the direction of motion of which is directed at a different angle to the longitudinal axis 11 of the spindle. This depends on the constructional design of the actuator casing 3 and of the coupling element 13.

As further illustrated in FIG. 3, the coupling housing 17 comprises a second slotted guide 27 with substantially the same course as the first slotted guide 15 of the cover 19. The second slotted guide 27 is thereby arranged facing the first slotted guide 15, wherein the second slotted guide 27 is designed in the coupling housing 17, in particular in a floor of the coupling housing 17. The sliding block 9 is constructed in such a way that it engages with both the first slotted guide 15 and the second slotted guide 27. The sliding block 9 is thereby simultaneously guided into both the first slotted guide 15 and the second slotted guide 27. The sliding block 9 comprises two sliding engagement elements 10 for this purpose that are substantially guided on two sides within the first slotted guide 15 or respectively the second slotted guide 27.

The engagement elements 10 in the embodiment are configured in an elongated manner. Other constructional configurations of the engagement elements 10 such as pin-shaped are conceivable.

In the exemplary embodiment according to FIG. 1 to FIG. 3, the first slotted guide 15 and the second slotted guide 27 are inserted in the cover 19 or in the coupling housing 17, wherein the first slotted guide 15 and the second slotted guide 27 are each designed as elongated hole. Alternatively, conceivable is that the first slotted guide 15 and/or the second slotted guide 27 are inserted in the cover 19 or the coupling housing 17 as pocket-shaped groove.

Another alternative is that only a first slotted guide 15 is provided on the coupling element 13. The first slotted guide 15 can then be provided either on the coupling housing 17 or on the cover 19. The sliding block 9 in such a configuration could have just one corresponding engagement element 10.

The first slotted guide 15 and/or the second slotted guide 27 in the embodiment have a linear course, which has a substantially identical slope. Alternatively conceivable is that a course of the first slotted guide 15 or of the second slotted guide 27 runs at least partially in a curved manner. For example, a course could run exponentially or logarithmically. For example, the course could initially run substantially parallel to the longitudinal axis 11 of the spindle 5 and then diverge into a steeply running section. It is thus possible to realize different speeds of movement of the coupling element 13 to be achieved if the spindle 5 is actuated. Depending on the course of the first slotted guide 15 or of the second slotted guide 27, varyingly high forces can also be transferred. The greater an angle of slope of the course of the first slotted guide 15 or of the second slotted guide 27 in relation to the longitudinal axis 11, the higher the forces and the higher the speeds of movement of the coupling element 13 that are implemented.

The arbitrary shape of the course of the first slotted guide 15 or of the second slotted guide 27 thus allows different motion characteristics of the coupling element 13, or of a segment of a seating or lying furniture item mechanically coupled with the coupling element 13, to be generated.

As can be seen in FIG. 1, a lever 29 is attached to the coupling element 13. Said lever 29 is attached to a front side 30 of the coupling element 13. The actuator assembly 1 can, for example, be flexibly coupled via the lever 29 with a segment of an adjustable seating or lying furniture item in such a way that allows the segment of the seating or lying furniture item to be moved or rotated.

By way of an example, FIG. 4 to FIG. 6 each illustrate a perspective view of an adjustable lying furniture item 31, in particular a frame 33 for a bed. FIG. 6 thereby illustrates a perspective partial section of the lying furniture item 31.

The adjustable lying furniture item 31 comprises an actuator assembly 1. Said actuator assembly 1 is fitted onto the frame 33. Said frame 33 has a first long side 26 and a second long side 38, wherein the actuator assembly 1 is attached to the first long side 36 or in the area of the first longitudinal axis 36. Alternatively, the actuator assembly 1 can also be attached in another area to the frame 33, for example in the middle in relative to the two long sides 36 and 38. The actuator assembly 1 is secured on the frame 33 by screw connections, for example. Other connecting techniques are conceivable. In particular, the actuator assembly 1 is arranged in a fixed position on the frame 33 or the first segment 35 in such a way that the actuator assembly 1 cannot be relatively shifted or moved in relation to the frame 33.

The frame 33 has a first segment 35 and a second segment 37, which are connected to each other in an articulated manner. For example, the second segment 37 is a head section and can be pivoted relative to the first segment 35. For this purpose, the frame 33 provides a joint (not shown) on each of the two long sides 36 and 38.

When actuating the spindle 5, as described according to FIG. 1 to 3, the coupling element 13 is shifted in parallel relative to the two long sides 36 and 38 of the frame 33. The lever 29 is thereby mechanically coupled with the second segment 27 in a joint 39 in an articulated manner. It is thus possible that the second segment 37 is pivoted around the joint not illustrated in FIG. 4 between the two segments 35 and 37. Pivoting is effected according to a direction of rotation 41.

FIG. 4 shows the frame 33 from an underside, while FIG. 5 shows the frame from an upper side.

Overall, the frame 33 requires only a low building height 43 together with the actuator assembly 1 (see FIGS. 4 and 5). The overall configuration of the actuator assembly 1 is very flat, which allows very slim, flat and/or space-saving frames 33 to be achieved.

FIG. 6 illustrates a detail of the lying furniture item 31 in which the arrangement of the actuator assembly 1 on the frame 33 is illustrated in an enlarged view.

In an alternative embodiment, the actuator assembly 1, which is arranged on the first long side 36 of the frame 33 in FIG. 4 to 6, can also be arranged as a substantially analogous actuator assembly 1 with a drive on the opposite second long side 38. Here, the drives of both actuator assemblies 1 can be electrically synchronized, thus allowing both said actuator assemblies 1 to be actuated simultaneously. As also described in detail below based on the further embodiments according to FIGS. 7 and 8, this results in increased mechanical stability and stiffness of the frame 33 and/or of a segment of an adjustable seating or lying furniture item, for example the second segment 37 according to FIGS. 4 to 6, when the segment is pivoted.

FIG. 7 shows a perspective, schematic view of a further implementation of an actuator assembly 1 with an actuator casing 3. Said actuator assembly 1 largely has the above-described features, and thus no renewed description is required. Differences between the embodiments will now be explained in detail. The actuator assembly 1 can, for example, be secured on the frame 33, which is shown in FIG. 4 to 6.

The actuator assembly 1 comprises two coupling elements 13, each having a sliding block 9. The coupling elements 13 are designed according to the embodiment described based on FIG. 1 to 6 and are each secured on the actuator casing 3. The actuator assembly 1 comprises a spindle 5, which is mechanically coupled with both the sliding blocks 9 of the coupling elements 13. The spindle 5 is thus a continuous shaft.

FIG. 7 further also shows a possible embodiment of a drive 45 with a gear. Said drive 45 is arranged in a corresponding area within the actuator casing 3 and mounted therein, for example. The drive 45 actuates the spindle 5 by a motor and a gear mechanically coupled therewith, which actuates the two sliding blocks 9 of both coupling elements 13. The drive 45 thus constitutes a one-sided drive 45.

Both coupling elements 13 each have the first slotted guide 15, which runs in an opposite course, however. In order to move both levers and thus, for example, to move a segment of an adjustable seating or lying furniture item, both coupling elements 13 need to be moved or shifted in a substantially synchronous manner, i.e. in a same direction of motion according to the double arrow 23, when the drive 45 is actuated. For this purpose, the spindle 5 has a counterclockwise external thread in a first area 47, in which the sliding block 9 of the coupling element 13 arranged on the left in FIG. 7 is moved, and a clockwise thread in a second area 49, in which the sliding block 9 of the coupling element 13 arranged on the right in FIG. 7 is moved. Thus, when the spindle 5 is actuated by the drive 45, both sliding blocks 9 are moved in different axial directions in relation to the longitudinal axis 11, depending on a direction of rotation of the spindle 5 around the longitudinal axis 11. This causes both levers 29 to be moved in a same direction of movement according to the double arrow 23.

The two thread variants can be interchanged as an alternative as well.

The provision of a clockwise and counterclockwise thread enables axial forces on the drive 45, which can also be designated as the drive unit, to be considerably reduced. This in turn reduces any wear of the drive 45 and/or the components of the actuator assembly 1 involved in the motion transmission.

Alternatively, a plurality of coupling elements 13, three or more, for example, can also be connected in series analogously to the embodiment shown in FIG. 7, thus allowing the actuator assembly 1 to be designed modularly and depending on each individual case of use.

The actuator assembly 1 shown in FIG. 7 allows a segment of an adjustable seating or lying furniture item 31, mechanically coupled with the levers 29, to be actuated at two places, i.e. at two coupling points of the levers 29 with the segment. This allows a load, such as a weight force of a person located on the lying furniture item 31, to be introduced symmetrically onto the actuator assembly, thus distributing the flow of forces between both levers 29 or both coupling elements 13. A further advantage is that the stiffness properties of the overall frame 33 and/or of the segment to be adjusted are improved as a result. It is also possible to mechanically couple both levers 29 with different segments, thus allowing two or more segments to be moved at the same time with a drive 45 or an actuator assembly 1.

The actuator assembly 1 in FIG. 7 merely shows the arrangement of the coupling elements 13 in relation to the longitudinal axis 11 of the spindle 5 in an exemplary manner. For example, the spindle 5 can be shorter and the coupling elements 13 can be arranged nearer to each other.

FIG. 8 shows a perspective, schematic partial view of a lying furniture item 1 with an actuator assembly 1 configured according to another embodiment. Said actuator assembly 1 has substantially the same features as the actuator assembly 1 according to FIG. 7, the difference being that the drive 45 is arranged between the two coupling elements 13. The drive 45 actuates two spindles 5, wherein one spindle 5 actuates the coupling element 13 arranged on the left in FIG. 8 and one spindle 5 actuates the coupling element 13 arranged on the right in FIG. 8. The drive 45 is thus a two-sided drive 45. Said drive 45 can have a gear via which a motor actuates both spindles 5. Alternatively, both spindles 5 can each be actuated via a separate gear by the motor of drive 45, wherein, for example, different transmission ratios can be set for each coupling element 13. This allows different speeds of movement to be set for both coupling elements 13 by a drive 45 and thus different forces to be transmitted.

The actuator assembly 1 according to FIG. 8 essentially allows for the aforementioned advantages in relation to the embodiment described based on FIG. 7.

In a further alternative embodiment, the coupling element 13 can also be mechanically coupled with a further adjustable segment of a seating or lying furniture item on a side of a coupling element 13 averted from the lever 29, in particular on a rear side 32 (see FIG. 1).

This allows two segments of the seating or lying furniture items to be moved when a coupling element 13 is shifted.

The previously described embodiments allow functions, such as the so-called "wall-hugging" or even an overstretching of a matrass deposited on the frame 33, to be achieved. A matrass immersion when a segment of the lounging or seating furniture item is pivoted is thus reduced. This is described in detail based on FIGS. 9 and 10.

FIG. 9 shows a schematic side view of an adjustable lying furniture item 31. Said lying furniture item 31 is arranged near to a wall 51. The lying furniture item comprises a first segment 35, a second segment 37 and a third segment 38. The first segment 35 is connected with the second segment 37 and the third segment 38 in an articulated manner. The second segment 37 is, for example, a head section of the lying furniture item 31 and the third segment 38 is, for example, a foot section of the lying furniture item 31. The first segment 35 is mechanically connected with a floor in a stationary manner via bearings 53 (schematically illustrated).

The lying furniture item 31, in particular the second segment 37, in a reclining position in which at least the first segment 35 and the second segment 37 are arranged on a common level, in particular parallel to a floor surface of the floor starting from a side facing the wall, has a stipulated interval $X_0$ to the wall 51. The interval $X_0$ can, for example, be the interval at which the lying furniture item 31 has the smallest interval with an element to the wall 51. Other definitions of the interval are conceivable.

If the second segment 37 is now pivoted by an actuator assembly 1 according to FIGS. 1 to 8, for example in a position 37' illustrated as a dashed line in FIG. 9, the first interval $X_0$ increases to the extent that the second segment 37 or the lying furniture item has a second interval $X_1$ to the wall. Such an interval enlargement is undesired, as, for example, the position of a person in relation to a nightstand or such like has been changed and the nightstand is possibly no longer within easy reach.

In order to ensure the interval $X_0$ in the pivoted position 37' of the second segment 37 as well, the stationary connection of the first segment 35 is cancelled and a horizontal shift made possible. This can, for example, be achieved with the aid of a lower frame 55 and a rail system, as shown in FIG. 10. The lower frame 55 is mounted in a stationary manner on the floor above the bearing 53.

As shown in FIG. 10, the lower frame 55 is thereby kinematically coupled with the second segment 37, via the lever 57, for example. Other kinematic couplings are conceivable as an alternative. If the second segment 37 is now pivoted, the kinematic coupling ensures that the lying furniture item 31 always substantially maintains the interval $X_0$ to the wall 51. For instance, a drive performance of an actuator assembly 1 for pivoting the second segment 37 is thereby used to achieve the horizontal shift of the first segment 35 and thus of the lying furniture item 31. During the pivoting of the second segment 37, the interval $X_0$ to the wall 51 thus always remains substantially the same.

As an alternative to the kinematic coupling, a further actuator assembly 1 according to the described embodiments can also be provided, in order to achieve the horizontal shift. An actuator assembly 1 would thus horizontally shift the first segment, whereas the other actuator assembly 1 would pivot the second segment 37. As an alternative, an actuator assembly 1 can also be provided in which the coupling element 13 is one the one hand mechanically coupled with the second segment 37 for pivoting the second segment 37 and is on the other hand mechanically coupled with the first segment 35.

A significant advantage of the described actuator assembly 1 and lounge furniture item 31 is that short levers and high transmission ratios can be achieved. Thus larger forces can be transmitted. In addition, an actuator assembly 1 can be built of only very few parts. Furthermore, an actuator assembly 1 can be used modularly, as described. It is to be understood that the described actuator assemblies 1 can also be arranged in a seating furniture item. The actuator assemblies 1 can be secured on either a frame or base frame of the seating furniture item.

Another conceivable alternative is that the components of an actuator assembly 1 are not arranged in a separate actuator casing, but instead, for example, directly on a frame of a seating or lying furniture item, in order to fulfil the described functions and advantages.

The invention claimed is:

1. An actuator assembly for an adjustable seating or lying furniture item, in particular for an adjustable bed or an adjustable comfortable armchair, comprising:

a spindle that can be activated with a drive for causing axial rotation, which is mounted in a stationary manner;

a sliding block mechanically coupled with the spindle, which can be moved parallel in relation to a longitudinal axis of the spindle when the spindle is activated; and a coupling element mounted in a manner allowing it to be moved in relation to the spindle, the coupling element having a first slotted guide, in which the sliding block is at least partially guided such that the coupling element is shifted in a different direction to the longitudinal axis of the spindle when the spindle is activated and when the sliding block is moved in the first slotted guide relative to the coupling element, in order to move a segment of the adjustable seating or lying furniture item that can be mechanically coupled with the coupling element.

2. The actuator assembly according to claim 1, comprising a drive, including a motor, in particular an electric motor, and a gear coupled with the motor, wherein the gear transmits a rotational movement to the spindle.

3. The actuator assembly according to claim 1, wherein the spindle comprises an external thread and the sliding block comprises an internal thread, via which the sliding block is coupled with the external thread of the spindle.

4. The actuator assembly according to claim 1, wherein the coupling element can be mechanically coupled with a further segment of the adjustable seating or lying furniture item in such a way that movement is caused on the further segment when the coupling element is shifted.

5. The actuator assembly according to claim 1, wherein the first slotted guide has a run, which runs at least partially in a linear and/or curved manner.

6. The actuator assembly according to claim 1, wherein the coupling element can be jointly coupled via at least one lever with the segment and/or with the further segment.

7. The actuator assembly according to claim 1, wherein the coupling element comprises a coupling housing with a cover that can be firmly attached to the coupling housing, which at least partially surrounds the sliding block and the spindle.

8. The actuator assembly according to claim 7, wherein the cover or the coupling housing comprises the first slotted guide.

9. The actuator assembly according to claim 7, wherein the cover comprises the first slotted guide and the coupling housing comprises a second slotted guide, wherein the second slotted guide has an identical run to the first slotted guide and faces the first slotted guide, and wherein the sliding block is guided simultaneously at least partially in both the first slotted guide and the second slotted guide.

10. The actuator assembly according to claim 1, wherein the actuator assembly is arranged in an actuator casing, and wherein the actuator casing can be secured in a stationary manner on the adjustable seating or lying furniture item, in particular on a frame.

11. The actuator assembly according to claim 10, wherein the spindle is mounted in a stationary manner on the actuator casing.

12. The actuator assembly according to claim 10 or 11, wherein the coupling element is mounted on the actuator housing in a manner allowing it to be moved.

13. An adjustable seating or lying furniture item, comprising at least two flexibly connected segments and an actuator assembly according to claim 1, wherein the coupling element of the actuator assembly is mechanically coupled with at least one segment in such a way that a movement of the coupling element when the spindle is activated is transferred to the at least one segment for displacing the at least one segment.

* * * * *